US008054277B2

(12) United States Patent
Huang

(10) Patent No.: US 8,054,277 B2
(45) Date of Patent: Nov. 8, 2011

(54) LIQUID CRYSTAL DISPLAY HAVING POLARITY ANALYZING UNIT FOR DETERMINING POLARITIES PIXELS THEREOF

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 757 days.

(21) Appl. No.: 12/214,181

(22) Filed: Jun. 16, 2008

(65) Prior Publication Data

US 2008/0309604 A1 Dec. 18, 2008

(30) Foreign Application Priority Data

Jun. 15, 2007 (CN) ..... 2007 1 0075050

(51) Int. Cl.
*G09G 3/36* (2006.01)

(52) U.S. Cl. ..... 345/98; 345/208

(58) Field of Classification Search ..... 345/87–104, 345/204–213, 690–699
See application file for complete search history.

(56) References Cited

U.S. PATENT DOCUMENTS

| | | | | |
|---|---|---|---|---|
| 5,365,284 | A * | 11/1994 | Matsumoto et al. | 348/793 |
| 5,438,342 | A * | 8/1995 | Yamaguchi | 345/58 |
| 5,856,816 | A * | 1/1999 | Youn | 345/98 |
| 5,926,172 | A * | 7/1999 | Hanley | 345/210 |
| 2005/0253827 | A1 | 11/2005 | Hung et al. | |
| 2006/0187164 | A1 | 8/2006 | Okuno | |

FOREIGN PATENT DOCUMENTS

TW I260573 B 8/2006

* cited by examiner

*Primary Examiner* — Stephen Sherman
(74) *Attorney, Agent, or Firm* — Altis Law Group, Inc.

(57) ABSTRACT

A liquid crystal display (300) includes a liquid crystal panel (310) having a plurality of pixels $P_{(i,j)}$ arranged in a matrix, a brightness identification unit (343) configured for identifying a brightness of an image element to be displayed by at least one pixel, a polarity analyzing unit (344) configured for analyzing a result of the identification, and a data circuit (330). The polarity analyzing unit is also configured for generating a composed binary signal having a first binary portion the same as the primary display signal and an additive second binary portion. The data circuit is configured to provide a data voltage to drive the pixel according to the signal. A value of the data voltage is determined by a first binary portion of the composed binary signal, and a polarity of the pixel is determined by the second binary portion of the composed binary signal.

20 Claims, 2 Drawing Sheets

LIQUID CRYSTAL DISPLAY HAVING POLARITY ANALYZING UNIT FOR DETERMINING POLARITIES PIXELS THEREOF

FIELD OF THE INVENTION

Embodiments of the present disclosure relate to liquid crystal displays (LCDs), and more particularly to an LCD employing a polarity analyzing unit to determine polarities of pixels thereof.

GENERAL BACKGROUND

LCDs are widely used in various information products, such as notebooks, personal digital assistants, video cameras, and the like. A conventional LCD utilizes liquid crystal molecules to control light transmission in each pixel of the LCD. In general, the conventional LCD employs an inversion system, such as a frame inversion system, for example, to drive the liquid crystal molecules.

FIG. 3 illustrates a series of polarity patterns of the pixels of a conventional LCD which employs the frame inversion system. In order to simplify the following explanation, only a 4-by-4 sub-matrix of pixels of the LCD is shown. As shown in FIG. 3, polarities of all the pixels are the same in each frame period, and the polarity of each pixel is inverted to an opposite polarity in a subsequent frame period. For example, the polarities of all the pixels are positive in the Nth frame period, and are inverted to be negative in the (N+1)th frame period.

By employing the frame inversion system, the LCD can be protected from what is known as "burn in" where continual operation of the video signal causes damage to the LCD. However, because the polarities of all the pixels are the same in each frame period, and are simultaneously inverted in the subsequent frame period, a user may perceive that an image displayed by the LCD is skipping during the inversion of the polarities of the pixels. Thereby, a so-called flicker phenomenon is generated in the LCD, and the display quality of the LCD is unsatisfactory.

From the foregoing, it should be appreciated that there is a need for an LCD to overcome the "burn-in" effect. To this end, there is a need for an LCD to overcome the so-called flicker phenomenon.

SUMMARY

In one aspect, a liquid crystal display includes a plurality of pixels arranged in a matrix, a brightness identification unit configured for identifying a brightness of an image element to be displayed by at least one pixel from the plurality of pixels, a polarity analyzing unit configured for analyzing a result of the identification, and for generating a composed binary signal, and a data circuit configured to provide a data voltage to drive the at least one pixel according to the composed binary signal. The brightness of the image element is determined by a corresponding primary display signal. The composed binary signal having a first binary portion the same as the primary display signal and an additive second binary portion. A value of the data voltage is determined by the first binary portion of the composed binary signal, and a polarity of the at least one pixel is determined by the second binary portion of the composed binary signal.

In another aspect, a liquid crystal display includes a plurality of pixels, a brightness identification unit, a polarity analyzing unit, and a data circuit. Each pixel corresponds to a first signal having a bright state or a dark state. The brightness identification unit is configured for identifying the first signal of each pixel. The polarity analyzing unit is configured for analyzing a result of the identification in order to generate a second signal having an additive portion. The data circuit is configured to provide a data voltage to drive the pixel according to the second signal. A value of the data voltage is determined by the first signal, and a polarity of the pixel is determined by the additive portion of the second signal.

Other novel features and advantages will become more apparent from the following detailed description when taken in conjunction with the accompanying drawings.

DETAILED DESCRIPTION OF CERTAIN INVENTIVE EMBODIMENTS

Reference will now be made to the drawings to describe certain embodiments of the present disclosure in detail.

Figure 1:
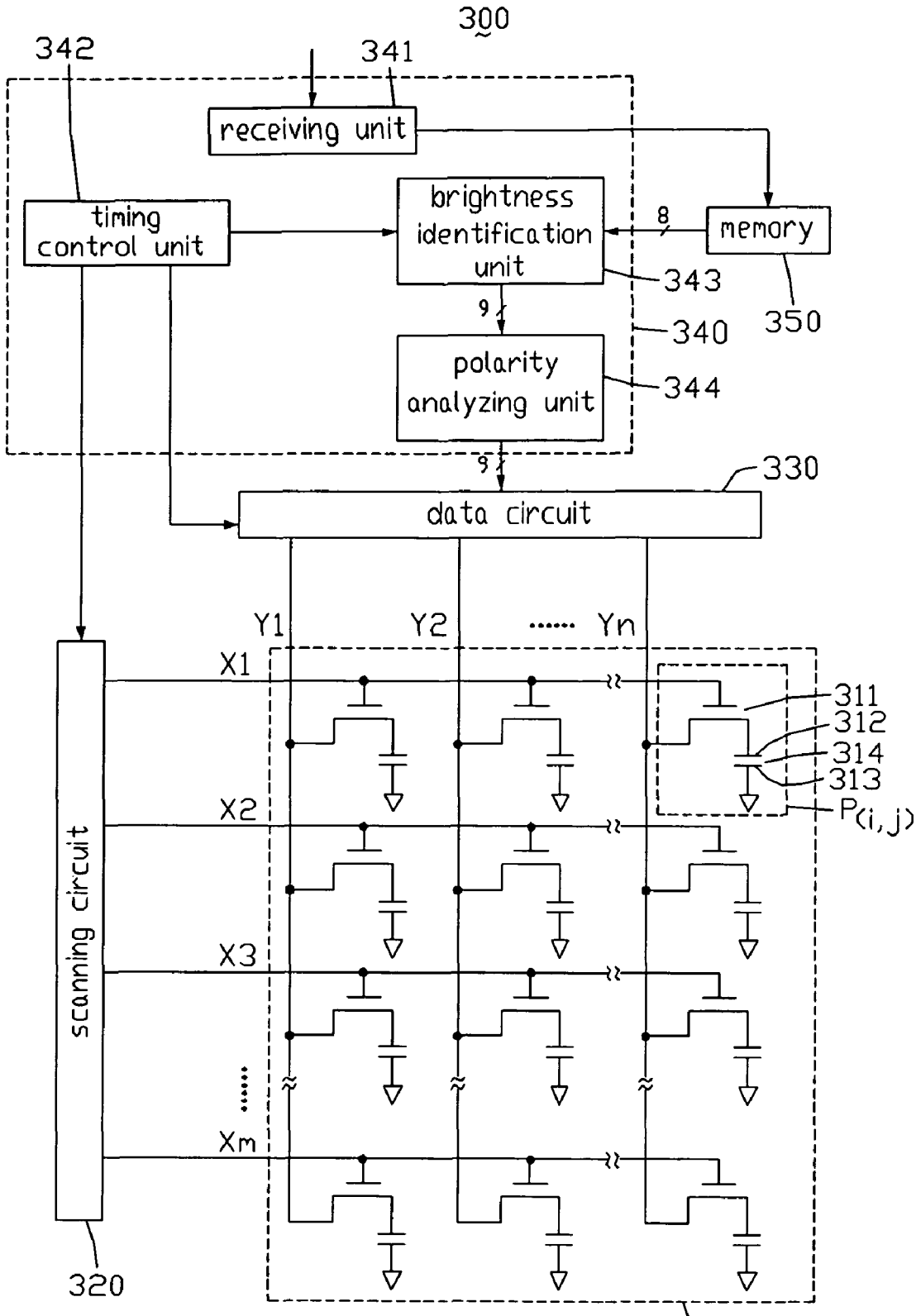
FIG. 1 is essentially an abbreviated circuit diagram of an LCD according to one embodiment of the present disclosure, the LCD including a data circuit.

FIG. 1 is essentially an abbreviated circuit diagram of an LCD according to one embodiment of the present disclosure. The LCD 300 includes a liquid crystal panel 310, a scanning circuit 320, a data circuit 330, a timing controller 340, and a memory 350.

The liquid crystal panel 310 includes m rows of parallel scanning lines Xl~Xm (where m is a natural number), n columns of parallel data lines Yl~Yn (where n is also a natural number) perpendicular to the scanning lines Xl~Xm, and a plurality of pixels $P_{(i,j)}$ (where i, j are both natural numbers, $1 \leqq i \leqq m$, $1 \leqq j \leqq n$) cooperatively defined by the crossing scanning lines Xl~Xm and data lines Yl~Yn. Thereby, the pixels $P_{(i,j)}$ are arranged in a matrix having m rows and n columns. The scanning lines Xl~Xm are electrically coupled to the scanning circuit 320, and the data lines Yl~Yn are electrically coupled to the data circuit 330. In the liquid crystal panel 310, each pixel $P_{(i,j)}$ has a respective address corresponding to a digital address signal. The digital address signal includes a horizontal address code indicating which row the pixel $P_{(i,j)}$ is located in, and a vertical address code indicating which column the pixel $P_{(i,j)}$ is located in. In the following description, $P_{(i,j)}$ refers to the pixel located in the (i)th row and (j)th column of the matrix.

Each pixel $P_{(i,j)}$ includes a thin-film transistor (TFT) 311, a pixel electrode 312, and a common electrode 313. A gate electrode of the TFT 311 is electrically coupled to a corresponding one of the scanning lines Xl~Xm, and a source electrode of the TFT 311 is electrically coupled to a corresponding one of the data lines Yl~Yn. Furthermore, a drain electrode of the TFT 311 is electrically coupled to the pixel electrode 312. The common electrode 313 is generally opposite to the pixel electrode 312, with a plurality of liquid crystal molecules (not shown) sandwiched therebetween, so as to cooperatively form a liquid crystal capacitor 314.

The timing controller 340 includes a receiving unit 341, a timing control unit 342, a brightness identification unit 343, and a polarity analyzing unit 344. The receiving unit 341 is configured to receive digital display signals from an external circuit (not shown), and store the digital display signals in the memory 350. The timing control unit 342 is configured to control drive timings of the scanning circuit 320, the data circuit 330, and the brightness identification unit 343. The brightness identification unit 343 is configured to identify a brightness of a color to be displayed by each pixel $P_{(i,j)}$ according to the corresponding digital display signal. Furthermore, the brightness identification unit 343 is configured to provide a brightness sign bit B1 to the display signal according to a result of the brightness identification. The polarity analyzing unit 344 is configured to analyze the brightness sign bit B1, and correspondingly convert the brightness sign bit B1 into a polarity control bit B2. The polarity analyzing unit 344 includes an inner register (not shown).

Figure 2:
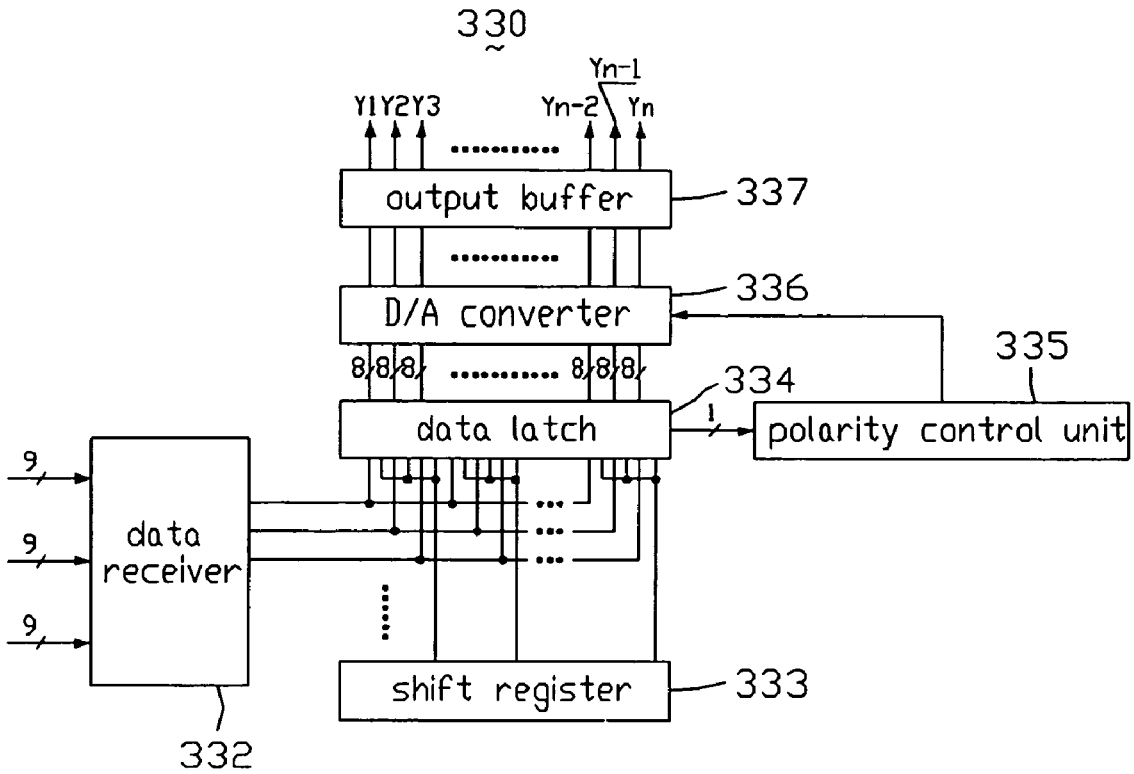
FIG. 2 is an abbreviated circuit diagram of the data circuit of the LCD of FIG. 1.
Figure 3:
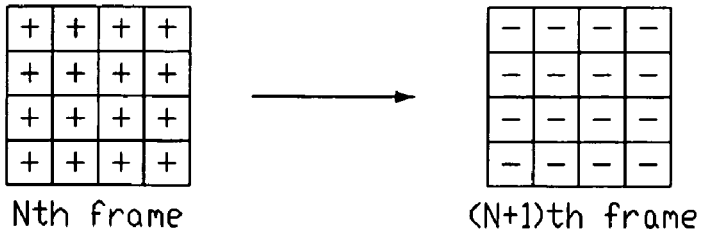
FIG. 3 (RELATED ART)
FIG. 3 illustrates a series of polarity patterns of pixels of a conventional LCD which employ a frame inversion driving system.

Referring to FIG. 2, the data circuit 330 is configured to provide a data voltage to drive one or more pixels according to a signal generated by the polarity analyzing unit 344. In one embodiment, the data circuit 330 includes a data receiver 332, a shift register 333, a data latch 334, a polarity control unit 335, a digital to analog (D/A) converter 336, and an output buffer 337. The data receiver 332 is configured to receive the display signals with the polarity control bits B2 from the polarity analyzing unit 344. The shift register 333 is configured to generate a plurality of shift pulses according to a timing control signal received from the timing control unit 342, and send the shift pulses to the data latch 334. The data latch 334 is configured to receive the display signals with the polarity control bits B2 from the data receiver 332 according to the shift pulses, and separate the polarity control bit B2 from the corresponding display signal. The polarity control unit 335 is configured to provide a polarity control signal according to the polarity control bit B2. The D/A converter 336 is configured to convert each display signal into a data voltage having a polarity that is determined by the polarity control signal. The output buffer 337 is configured to output the data voltages to the pixels $P_{(i,j)}$ via the data lines Yl~Yn.

Operation of the LCD 300 is as follows. To simplify the following description, only an operation of the (i)th row of pixels $P_{(i,j)}$ of the LCD 300 in an Nth frame period is taken as an example. However, it may be understood that a similar operation may take place according to any row of the pixels $P_{(i,j)}$ and in any frame period. In addition, the following definitions and labels may be defined. A primary display signal $D0_{(i,j)}$ refers to a digital display signal corresponding to the pixel $P_{(i,j)}$ received by the receiving unit 341 in the Nth frame period. A brightness sign bit $B1_{(i,j)}$ refers to one of the brightness sign bits B1 corresponding to the pixel $P_{(i,j)}$ provided by the brightness identification unit 343 in the Nth frame period. A polarity control bit $B2_{(i,j)}$ refers to one of the polarity control bits B2 corresponding to the pixel $P_{(i,j)}$ provided by the polarity analyzing unit 344 in the Nth frame period. A polarity control bit $B2^*_{(i,j)}$ refers to one of the polarity control bits B2 corresponding to the pixel $P_{(i,j)}$ in an (N−1)th frame period. A first display signal $D1_{(i,j)}$ refers to the primary display signal $D0_{(i,j)}$ with the brightness sign bit $B1_{(i,j)}$. A second display signal $D2_{(i,j)}$ refers to the primary digital display signal $D0_{(i,j)}$ with the polarity control bit $B2_{(i,j)}$.

Moreover, the pixel $P_{(i,j)}$ is defined as having a positive polarity when the data voltage received by the pixel electrode 312 is greater than a reference voltage (usually named as a common voltage generated by a common voltage circuit (not shown)) received by the common electrode 313. Conversely, the pixel $P_{(i,j)}$ is defined as having a negative polarity when the data voltage is lower than the reference voltage.

The receiving unit 341 may receive digital display signals from an external circuit (not shown) and output the digital display signals to the timing controller 340 in the Nth frame period. The receiving unit 341 may further output the primary display signal $D0_{(i,j)}$ to the memory 350. In particular, each primary display signal $D0_{(i,j)}$ is an 8-bit digital signal selected from the binary numbers 00000000~11111111, corresponding to one of 256 gray levels.

The brightness identification unit 343 receives and processes the primary display signal $D0_{(i,j)}$ under the control of an internal timing control signal provided by the timing control unit 342. The brightness identification unit 343 then recognizes a value of each primary display signal $D0_{(i,j)}$ to identify a brightness of a color to be displayed by the corresponding pixel $P_{(i,j)}$, and accordingly generates a corresponding brightness sign bit $B1_{(i,j)}$. For example, when the primary display signal $D0_{(i,j)}$ is in a range from 00000000~01110111, the primary display signal $D0_{(i,j)}$ corresponds to a gray level selected from the first to the 119th gray level. The brightness identification unit 343 identifies the primary display signal $D0_{(i,j)}$ as being a dark signal (i.e. in a dark state), and provides a brightness sign bit $B1_{(i,j)}$ equal to 0 to the primary display signal $D0_{(i,j)}$In another example, when the primary display signal $D0_{(i,j)}$ is in a range from 01111000~11111111, the primary display signal $D0_{(i,j)}$ corresponds to a gray level selected from the 120th to the 256th gray level. The brightness identification unit 343 identifies the primary display signal $D0_{(i,j)}$ as being a bright signal (i.e. in a bright state, and provides a brightness sign bit $B1_{(i,j)}$ equal to 1 to the primary display signal $D0_{(i,j)}$. The brightness sign bit $B1_{(i,j)}$ is added to the primary display signal $D0_{(i,j)}$ and treated as an independent most significant bit (i.e. the ninth bit) of the primary display signal $D0_{(i,j)}$. Thus, the 8-bit primary display signal $D0_{(i,j)}$ is converted into a 9-bit first display signal $D1_{(i,j)}$. For example, the corresponding first display signal $D1_{(i,j)}$ is 000000001 when the primary display signal $D0_{(i,j)}$ is 00000001. It may be appreciated that the bright state and the dark state may refer to an intensity of the corresponding gray levels of the primary display signal $D0_{(i,j)}$.

To convert the brightness sign bit $B1_{(i,j)}$ of the first display signal $D1_{(i,j)}$ into a polarity control bit $B2_{(i,j)}$, the polarity analyzing unit 344 receives the first display signal $D1_{(i,j)}$, and reads a corresponding vertical address code of the target pixel $P_{(i,j)}$ from an address register (not shown) of the LCD 300. The polarity analyzing unit 344 may then convert the brightness sign bit $B1_{(i,j)}$ of the first display signal $D1_{(i,j)}$ into a polarity control bit $B2_{(i,j)}$. Details of the conversion are explained as follows.

In one example, when the vertical address code indicates that the target pixel $P_{(i,j)}$ is located in the first column of the matrix (i.e. j=1), the target pixel $P_{(i,j)}$ is relabeled as $P_{(i,1)}$, and a polarity control bit $B2^*_{(i,1)}$ of the target pixel $P_{(i,1)}$ in the (N−1)th frame period is treated as a polarity inversion reference. Subsequently, the polarity analyzing unit 344 reads the polarity control bit $B2^*_{(i,1)}$ from the inner register, and generates a corresponding polarity control bit $B2_{(i,1)}$ having an opposite polarity to the polarity control bit $B2^*_{(i,1)}$. The polarity control bit $B2_{(i,1)}$ then replaces the brightness sign bit $B1_{(i,1)}$, such that the first display signal $D1_{(i,1)}$ is converted into a second display signal $D2_{(i,1)}$. For example, if the polarity control bit $B2^*_{(i,1)}$ is equal to 1, the polarity control bit $B2_{(i,1)}$ of the second display signal $D2_{(i,1)}$ is equal to 0; and vice versa.

In another example, when the vertical address code indicates that the target pixel $P_{(i,j)}$ is not located in the first column of the matrix (i.e. $2 \leqq j \leqq n$), and the brightness sign bit $B1_{(i,j)}$ of the first display signal $D1_{(i,j)}$ is equal to 0, the polarity analyzing unit 344 treats the polarity control bit $B2_{(i,j-1)}$ of the previous pixel $P_{(i,j-1)}$ as a inversion reference. Subsequently, the polarity analyzing unit 344 generates a corresponding polarity control bit $B2_{(i,j)}$ having an opposite polarity to the polarity control bit $B2_{(i,j-1)}$. For example, if the polarity control bit $B2_{(i,j-1)}$ is equal to 1, the polarity control bit $B2_{(i,j)}$ of the second display signal $D2_{(i,j)}$ is equal to 0; and vice versa. Similarly, the first display signal $D1_{(i,j)}$ is then converted into a second display signal $D2_{(i,j)}$; with the brightness sign bit $B1_{(i,j)}$ being replaced by the polarity control bit $B2_{(i,j)}$.

In another example, when the vertical address code indicates that the target pixel $P_{(i,j)}$ is not located in the first column of the matrix, and the brightness sign bit $B1_{(i,j)}$ of the first display signal $D1_{(i,j)}$ is equal to 1, the polarity analyzing unit 344 analyzes whether the first display signal $D1_{(i,j)}$ is the first bright signal in the (i)th row of pixels $P_{(i,j)}$ (e.g. the brightness sign bits $B1_{(i,1)}$~$B1_{(i,j-1)}$ are all equal to 0, and the brightness sign bit $B1_{(i,j)}$ is equal to 1). If the first display signal $D1_{(i,j)}$ is the first bright signal in the (i)th row of pixels $P_{(i,j)}$, then the brightness sign bit $B1_{(i,j)}$ of the first display signal $D1_{(i,j)}$ is maintained and treated as the polarity control bit $B2_{(i,j)}$. Accordingly, the first display signal $D1_{(i,j)}$ serves as the corresponding second display signal $D2_{(i,j)}$ without any conversion.

If the brightness sign bits $B1_{(i,1)}$~$B1_{(i,j-1)}$ are not all equal to 0, (e.g. at least one of the brightness sign bits $B1_{(i,k)}$ ($1 \leqq k \leqq j-1$) is equal to 1), assuming that a maximum value of k is q, a color to be displayed by a target pixel $P_{(i,q)}$, of the first display signal $D1_{(i,q)}$ ($1 \leqq q \leqq k$), is in a bright state. In this situation, the polarity analyzing unit 344 treats the polarity control bit $B2_{(i,q)}$ as a polarity inversion reference, and generates a corresponding polarity control bit $B2_{(i,j)}$ having an opposite polarity to the polarity control bit $B2_{(i,q)}$. The polarity control bit $B2_{(i,j)}$ then replaces the brightness sign bit $B1_{(i,j)}$, such that the first display signal $D1_{(i,j)}$ is converted into a second display signal $D2_{(i,j)}$.

To simplify the above description, an example is provided. In one example, when the brightness sign bits $B1_{(i,1)}$~$B1_{(i,7)}$ of the first display signals $D1_{(i,1)}$~$D1_{(i,7)}$ corresponding to the first to seventh pixels $P_{(i,1)}$~$P_{(i,7)}$ of the (i)th row of the matrix are respectively 0, 1, 0, 0, 1, 1, and 0, the polarity control bits $B2_{(i,1)}$~$B2_{(i,7)}$ generated by the polarity analyzing unit 344 are respectively 0, 1, 0, 1, 0, 1, and 0. Furthermore, when the first display signal $D1_{(i,j)}$ is converted to the second display signal $D2_{(i,j)}$, the polarity control bit $B2_{(i,j)}$ is outputted and stored in the inner register of the polarity analyzing unit 344.

Similarly, other primary display signals $D0_{(i,j)}$ of the same row of pixel $P_{(i,j)}$ are then converted to the corresponding second display signals $D2_{(i,j)}$ sequentially. All the second display signals $D2_{(i,j)}$ are further outputted to the data receiver 332 of the source driver 330. The data latch 334 receives each of the second display signals $D2_{(i,j)}$ according to a respective shift pulse provided by the shift register 333, and then distributes the polarity control bit $B2_{(i,j)}$ (i.e. the ninth bit of the second display signal $D2_{(i,j)}$) to the polarity control unit 335. Furthermore, the data latch 334 distributes the primary display signal $D0_{(i,j)}$ (i.e. the least significant eight bits of the second display signal $D2_{(i,j)}$) to the D/A converter 336. The polarity control unit 335 provides a corresponding polarity control signal to the D/A converter 336 according to the polarity control bit $B2_{(i,j)}$. The D/A converter 336 then converts each primary display signal $D0_{(i,j)}$ to a data voltage having the corresponding polarity. In particular, the data voltage has a positive polarity when the polarity control bit $B2_{(i,j)}$ is equal to 1, and has a negative polarity when the polarity control bit $B2_{(i,j)}$ is equal to 0.

The data voltages corresponding to all the pixels $P_{(i,j)}$ in the (i)th row of the matrix are then simultaneously outputted to the pixels $P_{(i,j)}$ via the output buffer 337 and the corresponding data lines $Y_j$. In addition, the (i)th row of pixels $P_{(i,j)}$ are activated by a scanning signal outputted from the scanning circuit 320 before the data voltages are applied thereto. Each of the data voltages then charges the corresponding liquid crystal capacitor 341 thereby generating an electric field between the pixel electrode 312 and the common electrode 313. The generated electric field drives the liquid crystal molecules to tilt to corresponding angles thereby displaying a particular color at the pixel $P_{(i,j)}$.

After the pixel $P_{(i,j)}$ generates the particular color, the (i+1)th to (m)th rows of pixels 340 are activated to display corresponding colors sequentially during the Nth frame period. It may be understood that the driving process for each row is similar to the above-described Xth row of pixels 340. Each color serves as an image element, and the aggregation of the image elements displayed by all the pixels $P_{(i,j)}$ of the LCD 300 simultaneously constitutes an image viewed by a user.

In summary, the LCD 300 employs the brightness identification unit 343 to identify the brightness of a color to be displayed by the each pixel $P_{(i,j)}$. The LCD 300 further employs the polarity analyzing unit 344 to determine a polarity of the pixel $P_{(i,j)}$ according to an identification result and an address code of the pixel $P_{(i,j)}$. Thus, the polarities of all the pixels $P_{(i,j)}$ are prevented from being the same in each frame period. When the polarities of the pixels $P_{(i,j)}$ are inverted, a portion of the pixels $P_{(i,j)}$ have their polarities change from positive to negative, while the rest of the pixels $P_{(i,j)}$ have their polarities change from negative to positive. Thus, the skipping of images displayed by the LCD 300, that might otherwise exist, can be reduced or even eliminated. Accordingly, the so-called flicker phenomenon can be diminished or even eliminated, thus improving the display quality of the LCD 300.

It is to be further understood that even though numerous characteristics and advantages of preferred and exemplary embodiments have been set out in the foregoing description, together with details of structures and functions associated with the embodiments, the disclosure is illustrative only, and changes may be made in detail (including in matters of arrangement of parts) within the principles of the invention to the full extent indicated by the broad general meaning of the terms in which the appended claims are expressed.

What is claimed is:

1. A display device, comprising:

a display panel comprising a plurality of pixels arranged in a matrix;

a brightness identification unit configured for identifying a brightness of an image element to be displayed by at least one pixel from the plurality of pixels, wherein the brightness of the image element is determined by a corresponding primary display signal;

a polarity analyzing unit configured for analyzing a result of the identification, and for generating a composed binary signal, the composed binary signal having a first binary portion the same as the primary display signal and an additive second binary portion; and a data circuit configured to provide a data voltage to drive the at least one pixel according to the composed binary signal;

wherein a value of the data voltage is determined by the first binary portion of the composed binary signal, and a polarity of the at least one pixel is determined by the second binary portion of the composed binary signal, the second binary portion is determined by a combination of the result of the identification and a location of a corresponding pixel where the primary display signal is to be applied.

2. The display device of claim 1, wherein the brightness identification unit converts the primary display signal to a converted display signal by providing an additive brightness sign bit.

3. The display device of claim 2, wherein the additive brightness sign bit is an independent bit from the primary display signal in the converted display signal.

4. The display device of claim 2, wherein the image element is identified as in a dark state when a value of the primary display signal is in a predetermined range, and the image element is identified as in a bright state when the value of the primary display signal is out of the predetermined range.

5. The display device of claim 4, wherein the additive brightness sign bit has a first value when the image element is identified as in a dark state, and has a second value when the image element is identified as in a bright state.

6. The display device of claim 5, wherein the additive brightness sign bit is converted to a polarity control bit by the polarity analyzing unit, and the polarity control bit is configured as the second binary portion of the composed binary signal.

7. The display device of claim 6, wherein the polarity control bit is determined by the brightness sign bit and the location of the corresponding pixel.

8. The display device of claim 7, wherein the polarity control bit is of an opposite polarity to a polarity in a corresponding pixel in a previous frame period when the at least one pixel is located in a first column of the matrix.

9. The display device of claim 7, wherein the polarity control signal is of an opposite polarity to a polarity in a corresponding nearest previous pixel of a same row of the matrix when the at least one pixel is not located in the first column of the matrix and the brightness signal bit has the first value.

10. The display device of claim 7, wherein the polarity control bit is of a same polarity as a polarity of a corresponding additive brightness signal bit when the at least one pixel is not located in the first column of the matrix, wherein the corresponding additive brightness signal bit has the second value, and wherein the additive brightness signal bit corresponding to all previous pixels of a same row of the matrix have the first value.

11. The display device of claim 7, wherein the polarity control bit is of an opposite polarity to a polarity of a corresponding nearest pixel whose additive brightness sign bit has a second value when the at least one pixel is not located in the first column of the matrix, the corresponding additive brightness signal bit has the second value, and at least one of the additive brightness signal bits corresponding to all previous pixels of a same row of the matrix has the second value.

12. The display device of claim 1, further comprising a receiving unit, the receiving unit configured to receive the primary display signals.

13. The display device of claim 12, further comprising a timing control unit, the timing control unit configured to control a drive timing of the data circuit and the additive brightness identification unit.

14. The display device of claim 13, further comprising a memory, the memory configured to store the primary display signal received by the receiving unit.

15. The display device of claim 1, wherein the data circuit comprises a data latch, the data latch configured to separate the second binary portion of the composed binary signal from the first portion of the composed binary signal.

16. The display device of claim 15, wherein the data circuit further comprises a polarity control unit, wherein the polarity control unit is configured to provide a polarity control signal according to the second portion of the composed binary signal.

17. The display device of claim 16, wherein the data circuit further comprises a digital to analog converter configured to convert the first portion of the composed binary signal to the data voltage, and wherein a polarity of the data voltage is determined by the polarity control signal.

18. The display device of claim 1, wherein each pixel comprises a respective address corresponding to a digital address signal, the digital address signal comprises a horizontal address code indicating which row the pixel to located in, and a vertical address code indicating which column the pixel is located in, the polarity analyzing unit obtains the location of the corresponding pixel according to the digital address signa of the corresponding pixel.

19. A display device, comprising:

a plurality of pixels, each pixel corresponding to a first signal having a bright state or a dark state;

a brightness identification unit configured for identifying the first signal of at least one pixel;

a polarity analyzing unit configured for analyzing a result of the identification in order to generate a second signal having an additive portion; and a data circuit configured to provide a data voltage to drive the at least one pixel according to the second signal;

wherein a value of the data voltage is determined by the first signal, and a polarity of the at least one pixel is determined by the additive portion of the second signal;

wherein the data circuit comprises data latch and polarity control unit, the data latch configured to separate the second binary proton of the composed binary signal from the first portion of the composed binary signal, the polarity control unit configured to provide a polarity control signal according to the second portion of the composed binary signal.

20. A liquid crystal display, comprising;

a liquid crystal panel comprising a plurality of pixel arranged in a matrix;

a brightness identification unit configured for identifying a brightness of an image element to be displayed by at least one pixel from the plurality of pixel, wherein the brightness of the image element is determined by a corresponding primary display signal;

a polarity analyzing unit configure for analyzing a result of the identification, and for generating a composed binary signal, the composed binary signal having a first binary portion the same as the primary display signal and an additive second binary portion; and a data circuit configured to provide a data voltage to drive the at least one pixel according to the composed binary signal;

wherein a value of the data voltage is determined by the first binary portion of the composed binary signal, and a polarity of the at least one pixel is determined by the second binary portion of the composed binary signal;

wherein the brightness identification unit converts the primary display signal to a converted display signal by providing an additive brightness sign bit;

wherein the image element is identified as in a dark state when a value of the primary display signal is in a predetermined range, and the image element is identified as in a bright state when the value of the primary display signal is out of the predetermined range;

wherein the additive brightness sign bit has a first value when the image element is identified as in a dark state, and has a second value when the image element is identified as in a bright state;

wherein the additive brightness sign bit is converted to polarity control bit by the polarity analyzing unit, and the polarity control bit is configured as the second binary portion of the composed binary signal;

wherein the polarity control bit is determined by at least one of the brightness sign bit and a location of a corresponding pixel.

* * * * *